United States Patent [19]

Natori et al.

[11] Patent Number: 4,812,278

[45] Date of Patent: Mar. 14, 1989

[54] PROCESS FOR PREPARING MOLD

[75] Inventors: Tatsuo Natori; Susumu Hioki, both of Kashiwa; Takashi Shimaguchi, Ibaraki; Toshihiro Yamada, Ibaraki; Akihide Watanabe, Ibaraki; Kensuke Kanekatsu, Yono, all of Japan

[73] Assignee: Hitachi, Ltd., Tokyo, Japan

[21] Appl. No.: 19,135

[22] Filed: Feb. 25, 1987

Related U.S. Application Data

[63] Continuation of Ser. No. 771,813, Sep. 3, 1985, abandoned.

[30] Foreign Application Priority Data

Aug. 31, 1984 [JP] Japan ..... 59-180513
Oct. 24, 1984 [JP] Japan ..... 59-222026

[51] Int. Cl.[4] ..... B29C 33/38

[52] U.S. Cl. ..... 264/221; 164/36; 264/86; 264/226

[58] Field of Search ..... 264/221, 225, 226, DIG. 44, 264/86, 317; 164/36, 35, 522

[56] References Cited

U.S. PATENT DOCUMENTS 2,476,993 7/1949 Milton et al. ..... 264/221 X
3,410,942 11/1968 Bayer ..... 264/221
4,443,261 4/1984 Nordqvist ..... 264/25 X

FOREIGN PATENT DOCUMENTS 54-69133 6/1979 Japan ..... 264/221

*Primary Examiner*—Jan H. Silbaugh
*Assistant Examiner*—Mary Lynn Fertig
*Attorney, Agent, or Firm*—Antonelli, Terry & Wands

[57] ABSTRACT

A cast article having a complicated shape of the appearance and the hollow can be obtained by forming a coating film on the surface of a pattern from a solvent-insoluble material to prepare a mold pattern, filling and hardening a molding material around the mold pattern, dissolving the pattern with a solvent, and removing the residue of dissolution and the coating film outside the mold.

41 Claims, 4 Drawing Sheets

PROCESS FOR PREPARING MOLD

This is a continuation of application Ser. No. 771,813, filed Sept. 3, 1985, now abandoned.

BACKGROUND OF THE INVENTION

1. Field of the Invention

The present invention relates to a process for preparing a slip casting mold for casting a slip, i.e. a slurry containing, for example, refractory powder such as ceramic powder metal powder, or carbon powder to produce cast articles, or a metal casting mold for casting an iron alloy, a copper alloy, an aluminum alloy, or the like to produce metal products, and more particularly to a process for preparing a mold suitable for cast articles requiring a core and a master mold having such complicated shape that it will not allow the molding to be drawn out because of, for example, back draft.

2. Description of the Prior Art

In cast articles having a complicated shape of appearance and/or hollow, there has heretofore been generally employed a method wherein a mold formed by a combination of a number of master molds and cores as desired is used. However, this method involves many problems in that a number of steps are required for preparing and assembling master molds and cores, that burr formation frequently occurs, and that the dimensional accuracy is apt to be low.

A method of solving these problems is disclosed, for example, in British Pat. No. 1,482,436. In this method, a mold comprises a portion of a complicated shape constituted by an organic material and a portion of a simple shape constituted by gypsum which serves to absorb water contained in a slip to be cast into a mold to thereby solidify the slip. The organic material is then dissolved away with a solvent for producing a cast article in a wet state (green body).

However, this method is devoid of the following consideration.

(i) The residue of the organic material is liable to remain locally on the surface of the green body. The more complicated the shape of the green body, the more difficult the removal of the residue.

(ii) In some cases, a long time is required to solidify the green body because the portion of the mold having a water absorptivity has only a small area.

There is another method of preparing a mold by using a foamed polystyrene pattern in place of a wax pattern used in the lost-wax process employed in precision casting of metal. However, this method, too, has several problems. An about 5 to 10 mm-thick refractory layer is stuck onto the surface of a foamed polystyrene pattern having substantially the same shape as that of a product. After solidification, th mold thus formed is contacted with a solvent such as trichlene for 1 to 3 hours to dissolve the pattern, a major part of which is dropped and removed outside the mold. However, the residue of polystyrene remains in a form of a layer substantially all over the inner wall of the mold. In this case, a particularly large amount of the residue remains in the hollow portion having a shape that will make it difficult to pour out the residue. For this reason, the mold is heated at high temperatures (about 1,000° to 1,100° C.) to burn the residue remaining in the mold. In this case also, there are the following problems.

(i) Smoke and soot are generated during the course of high-temperature heating of the mold. Part of the soot remains on the inner wall of the mold.

(ii) This method is applicable only to a mold prepared by using a binder and an aggregate having extremely good heat resistance.

U.S. Pat. No. 2,830,343 discloses a full mold casting method (filled mold casting method) comprising embedding a foamed polystyrene pattern in a molding sand, and directly pouring a molten metal into the pattern to let the pattern disappear by the heat of the molten metal and fill the space occupied by the pattern with the molten metal. Despite a small number of steps required in this method, however, there is liability of frequent occurrence of defects of such as impression formed in the skin of the mold by the residue of the burnt pattern and blow caused by a combustion gas of the pattern. In this case, the quality of the product is reduced.

OBJECT OF THE INVENTION

In view of the above, an object of the invention is to provide a process for preparing a mold which does not leave any residue of dissolution on the inner wall of the hollow of the mold even in the case of casting a cast article having a complicated shape of appearance and/or hollow.

SUMMARY OF THE INVENTION

In one aspect of the present invention, there is provided a process for preparing a mold comprising the steps of making a pattern from a solvent-soluble organic material such as foamed polystyrene, providing a mold pattern having a coating film formed on the surface of the pattern from a flexible and solvent-insoluble material capable of sticking to the surface of the pattern, such as a silicone rubber or a urethane sealant rubber, filling and hardening a molding material of either an inorganic one such as gypsum or an organic one around the above-mentioned mold pattern, dissolving the pattern with a solvent, and removing the residue of the pattern dissolved and the above-mentioned coating film outside the mold. Any residue of the pattern does not remain in the hollow of the mold at all. Furthermore, the solvent is not absorbed by the inner wall of the mold. Thus, not only high-quality cast articles can be obtained, but also the procedure is simple. Furthermore, since the applied coating film serves to flatten minute unevennesses on the surface of the pattern, the mold will have a smooth skin, leading to good skins of moldings. Moreover, the steps including making a number of master molds and/or cores and combining them to prepare a desired mold can be dispensed with or extremely simplified.

In another aspect of the present invention, there is provided a process for preparing a mold comprising the steps of making a pattern from a solvent-soluble organic material such as foamed polystyrene providing a mold pattern having a coating film formed on the surface of the pattern from a flexible and solvent-insoluble material capable of sticking to the surface of the pattern, such as a silicone rubber or a urethane sealant rubber, filling a molding material using a water-soluble binder (hereinafter often abbreviated as "water-soluble molding material" around the above-mentioned molding pattern, contacting a solvent with the pattern when the mold is still in a non-hardened state to dissolve the pattern, heating the mold to harden the same, softening the residue of the dissolved pattern with a solvent, and removing the residue together with the above-mentioned coating film outside the mold. The process can give the same effects as those of the above-mentioned first mode of the process of this invention.

The first mode of the process of this invention will be described in more detail. Any material other than foamed polystyrene, such as polyethylene or p-dichlorobenzene, may be used as the pattern material in so far as it is solvent-soluble. In the case of a foamed pattern, the extent of foaming should be determined according to the purpose. It may also be effective to use a non-foamed material in a very thin-wall or acute-angle portion of the pattern. The forming of a pattern may be carried out in accordance with not only foam molding using a mold, but also working with a machine or heated wire, etc. of a block foamed material, as well as a combination thereof.

The material used in coating the pattern must satisfy the following five conditions. (1) It must stick to a pattern to cover the whole surface of the pattern except for the portion through which the solvent is to be poured. (2) It must not erode a pattern. For example, it must not substantially contain any solvent which dissolves the pattern. (3) It must be solvent-insoluble to avoid sticking of the residue of dissolution to the inner wall of the mold and to prevent the residue of dissolution and the solvent from infiltrating therethrough to the inner wall of the mold. (4) The coating film formed from it must have flexibility and strength above a given level to facilitate picking and removal thereof outside the mold. (5) It must be hardened at temperatures not allowing the pattern to be deformed, and is preferably a cold-setting type. Thus the material is not limited to a silicone rubber or a urethane sealant rubber as mentioned above in so far as the above conditions are satisfied.

Cold-setting silicone rubbers (hereinafter often abbreviated as "RTV rubbers") as mentioned above can be classified into one-pack type and two-pack type ones. The former, namely one-pack RTV rubbers, can be employed in the present invention, since they react with water in air at ordinary temperatures, when applied on a pattern, to harden into elastic rubbers having adherence to almost all materials. The latter, namely two-pack RTV rubbers composed of separately packed rubber bases and hardening catalysts harden at ordinary temperatures by mixing the both components together. However, adherence to a resinous pattern is one of the requisites which the coating material of the present invention must meet. In this respect, self-bonding type ones among two-pack RTV rubbers can be employed in the present invention since they can meet the above-mentioned condition.

Any solvent may be suitably employed in so far as it can dissolve an organic resin used as the pattern. Examples of such solvents include acetone, trichloroethylene (trichlene), trichloroethane (triethane), tetrachloroethylene, carbon tetrachloride, benzene, and benzine. A mixture of two or more kinds of solvents as mentioned above may be used, too. The mode of use of the solvent may be in accordance with either liquid application, including spray application, or gas application.

The second mode of the process of the present invention will be described in more detail. The water-soluble binders employable in the present invention include carbonates such as sodium carbonate ($Na_2CO_3$) and potassium carbonate ($K_2CO_3$); sulfates such as ammonium sulfate ($(NH_4)_2SO_4$), potassium hydrogensulfate ($KHSO_4$) and sodium hydrogensulfate ($NaHSO_4$); chlorides such as potassium chloride (KCl), magnesium chloride ($MgCl_2$), and lithium chloride (LiCl); and phosphates such as sodium phosphate ($Na_3PO_4$), potassium phosphate ($K_3PO_4$), and dipotassium hydrogenphosphate ($K_2HPO_4$). The aggregates employable in the mold in the present invention include particles of refractories such as alumina ($Al_2O_3$), magnesia (MgO), zircon sand, silica sand, and glass beads.

In the case of slip casting, a thin-wall mold can be collapsed with only water contained in the slip. A thick-wall mold which cannot acquire a sufficient amount of water enough to be collapsed in desired to be reduced in wall thickness. Reduction of the wall thickness may be achieved by providing a hollow in the thick wall portion. In the case of ordinary metal molding, such care is not particularly needed.

Forming of a mold is done by tamping a kneaded mass composed of particles of a refractory, a water-soluble binder, and water. The forming time can be shortened if flowability is given to the molding material. For giving flowability to the molding material, an alcoholic solution of a water-soluble binder which is stable in the form of a hydrate at ordinary temperatures may be prepared, and a maximum permissiable amount of water for being fixed in the form of water of crystallization or a smaller amount of water may be added to the solution.

The water-soluble molding material is filled around the soluble pattern of foamed polystyrene or the like coated, over the surface thereof, with an insoluble coating film. Before the mold is hardened, a solvent such as acetone, triethane, or the like is sprayed or poured in the form of a liquid or a gas from the gate or the like of the pattern into the hollow thereof to dissolve the pattern by contacting the solvent with it. With the volume of the pattern thus drastically reduced, the mold is heat-dried and hardened. Though the pattern expands by this heating, no breakage of the mold occurs at all due to the drastically reduced volume of the patten brought about by its contact with the solvent. A foamed pattern expanded 40 times is reduced in volume to about 1/40 by contact thereof with a solvent. After the mold is hardened, the residue of the dissolved pattern is hardened. However, when it is contacted with a solvent again, the residue is softened to allow the coating film together therewith to be very easily picked and removed outside the mold. Thus the soluble mold having a desired hollow without any residue sticking to the inner wall thereof can be obtained.

In the case of slip casting, a slip such as a ceramic slip is poured into the hollow of the mold. The mold turns into a collapsible one from the surface thereof as it absorbs water contained in the slip, while the slip increasingly shrinks and deforms as it releases water to form a green body. In the process of the present invention, the mold does not inhibit the shrinkage and deformation of the green body occurring during the course of its dehydration, and softens from the surface thereof as it absorbs water. Therefore, the green body can be obtained without occurrence of cracks at all. Separation of the mold from the solidified green body can be facilitated by, for example, spraying water from the outside or placing them in a high-humidity atmosphere for a short time to effect the knock-out.

In the production of metal moldings of an iron alloy, a copper alloy, an aluminum alloy, or the like, the molten metal is cast in the hollow of the above-mentioned water-soluble mold and, after solidification of the metal, the mold is collapsed by contacting it with water or additionally applying an external force to it to pick up a molding. The process of this invention is particularly effective where a master mold or a core having a complicated shape is needed or where a soft metal is cast.

DETAILED DESCRIPTION OF THE INVENTION

The following Examples will specifically illustrate the present invention.

[Example 1]

Figure 1:
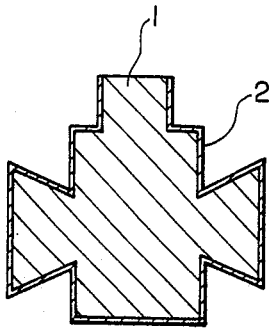
FIG. 1 is a crosssection of a pattern specimen usable in the process of this invention.

A foamed polystyrene specimen 1 (foaming ratio: 40) as shown in FIG. 1 was subjected, over the whole surface thereof except for the top portion, to a treatment as indicated in Table 1 to form a silicone rubber coating film 2. The specimen 1 was turned upside down, and fixed in the middle portion of a wooden flask 4 placed on a pattern plate 3. A gypsum slurry composed of 100 parts (parts by weight, the same will apply hereinbelow) and 50 parts of water was cast around the specimen 1. After solidification of the slurry, the mold 5 was turned upside down, followed by removal of the plate 3 and the wooden flask 4.

Acetone was sprayed from above the top of the specimen 1, which was quickly dissolved in the acetone to decrease its volume to about 1/40. The state of acetone infiltration into the mold and the state of adherence of the residue of dissolution to the inner wall of the mold were as shown in Table 1. For comparison, the results concerning a pattern having no coating film are shown in Table 1, too.

TABLE 1

| Surface treatment of pattern | Acetone infiltration into mold | Adherence of residue to inner wall of mold |
|---|---|---|
| Not made | Almost all acetone infiltrated. | Much adherence. The residue stuck much particularly to the recessed portions or the like to make it sufficiently impossible to remove it. |
| *silicone rubber coating | Acetone did not infiltrate at all. | No adherence at all. The rubber coating film, the residue, and the acetone were very easily removed en bloc outside the mold. |

*One-pack type oxime-free silicone rubber

As is apparent from the Table, without any surface treatment of the pattern, namely with the pattern having no insoluble coating film, the residue of the dissolved pattern stuck to the inner wall of the mold, and the removal of the residue remaining particularly in the complicated hollow-portions of the mold was difficult or impossible.

In contrast, with the pattern having a thin insoluble coating film 2 formed by coating the surface of the specimen 1 with the silicone rubber adherence of the residue of dissolution to the inner wall of the mold was not recognized at all. The rubber coating film was not dissolved in acetone at all, and did not lose its strength. This is why the residue of the polystyrene dissolved, the excess acetone, and the silicone rubber coating film were completely removed outside the mold.

[Example 2]

Figure 3:
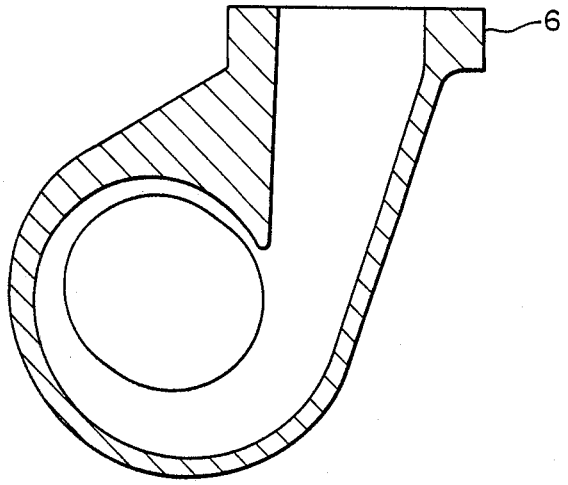
FIG. 3 is a crosssection of a foamed polystyrene pattern of a turbo charger casing usable in the process of this invention.

A foamed polystyrene pattern 6 (volume: about 200 $cm^3$, foaming ratio: 50) formed into the same shape as that of a casing of a turbo charger for a vehicle as shown in FIG. 3 was coated, over the whole surface thereof except for the top portion, with a silicone rubber in the same manner as in Example 1. After hardening of the silicone rubber, the pattern 6 was fixed on a pattern plate, and a wooden flask was disposed around the model in substantially the same manner as in Example 1.

100 parts of plaster of Paris, 8 parts of a cellulose powder, and 90 parts of water were put into a container, followed by preliminary agitation. The contents were then uniformly mixed and sufficiently foamed to prepare a gypsum slurry, which was subsequently cast inside the wooden flask to bury the whole polystyrene pattern in the above-mentioned gypsum slurry.

After 2 hours, the wooden flask and the plate were taken away, and the mold was turned upside down. Acetone was poured through the gate. The pattern 6 was quickly dissolved in acetone from the upper portion thereof upon contact thereof with the acetone. The residue stuck, in the form of a thin layer, to the inner surface of the rubber coating film. The residue was very soft since it was just after dissolution. Thus, pulling up the upper end portion of the silicone coating film enabled the residue of dissolution and the rubber coating film in a state of enclosing the residue to be very easily picked and removed outside the mold. As a result, a desired mold hollow having a high dimensional accuracy and a smooth mold skin therearound could be formed. The mold was dried in air for 12 hours, and further dried in a drying furnace of 80° C. for 8 hours.

An $Si_3N_4$ slip composed of an $Si_3N_4$ powder of 0.5 μm in average particle size as the main component, a deflocculant, a binder, and distilled water was cast into the hollow of the above-mentioned mold, and allowed to stand in air for 3 days. Thereafter, they were dried in a furnace of 80° C. for 12 hours and in a furnace of 100° C. for 12 hours to evaporate the water, followed by confirming that the constant weight was attained. They were further kept at 500° C. for 2 hours to burn the cellulose powder added to the mold, thus making the mold lose its binding power. Thus, the molding material was very easily removed with even weak vacuum suction to obtain a green body of $Si_3N_4$ having no burr at all, a high dimensional accuracy, and a smooth surface.

Figure 4:
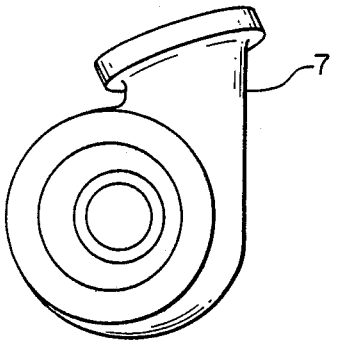
FIG. 4 is an appearance of a turbo charger casing of sintered $Si_3O_4$ or an aluminum alloy produced according to the process of this invention.

The green body was put into a nitriding furnace, gradually heated up from room temperature to 1850° C., at which it was heated for 2 hours, followed by gradual cooling. Thus a turbo charger casing 7 of high density comprising completely sintered $Si_3N_4$ as shown in FIG. 4 was obtained.

A molten aluminum alloy of 720° C. was cast into the hollow of a mold prepared in the same manner as described above in this Example. After solidification of the metal, the mold was removed. An aluminum alloy molding having a high dimensional accuracy and a smooth surface was obtained.

[Example 3]

Figure 5:
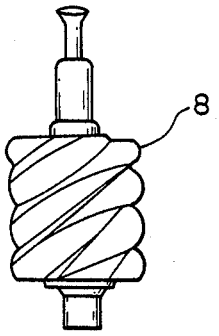
FIG. 5 is an appearance of a foamed polystyrene pattern of a screw rotor usable in the process of this invention.
Figure 6:
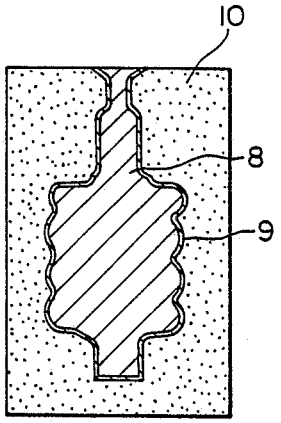
FIG. 6 is a crosssection of the above-mentioned foamed polystyrene pattern buried in the mold.

A foamed polystyrene pattern 8 (foaming ratio: 50) of a male rotor for a screw compressor as shown in FIG. 5 was immersed in a bath of a one-pack type oxime-free silicone rubber (RTV rubber), and then picked up to allow excess silicone rubber to drop off. As a result, an about 80 μm-thick hardened coating film of silicone rubber 9 as shown in FIG. 6 was formed.

In substantially the same manner as in Example 1, the pattern 8 was fixed on a pattern plate with the gate portion thereof bonded to the plate with an adhesive, and a metal flask was placed around the pattern. A gypsum slurry composed of 100 parts of molding gypsum, 75 parts of water, and 8 parts of a cellulose power was cast into the metal flask and solidified. Subsequently, the pattern 8 and the coating film 9 were removed in the same manner as in Example 2 to form a mold hollow 11. The mold 10 was then dried at 80° C. for 12 hours.

A uniformly mixed zirconia slip 12 composed of a zirconia powder of solid solution with $Y_2O_3$ containing 80% of particles of 1 μm or less in size as the main component, a deflocculant, a binder, and distilled water was cast into the hollow 11 of the above-mentioned mold 10, and allowed to stand in air for 6 days, followed by confirming that the constant weight was attained. They were then dried in a furnace of 80° C. for 8 hours.

Thereafter, the furnace temperature was raised to 400° C. at a rate of 100° C./hour, at which they were kept for 3 hours to burn the cellulose powder added to the mold, thus making the mold lose its binding power. Thus, the molding material was very easily removed with even weak vacuum suction to obtain a green body of zirconia having no burr at all, a high dimensional accuracy, and a smooth surface.

The green body was put into a calcination furnace, and the temperature was gradually raised to 1,500° C. at which the green body was kept for 3 hours to obtain a uniform and complete zirconia sinter.

An organic molding material composed of a furan resin as the binder and silica sand as the aggregate was filled around a pattern 8 which had been prepared in the same manner as described above in this Example and disposed in the middle portion of a metal flask placed on a pattern plate. After solidification of the molding material, acetone was sprayed to fall in contact with the pattern in the same manner as in Example 2. The pattern 8 and the coating film 9 were removed to form a mold hollow 11.

A good mold steel rotor having no burr at all was obtained by casting a molten mold steel of 1650° C. into the mold hollow 11.

[Example 4]

Figure 8:
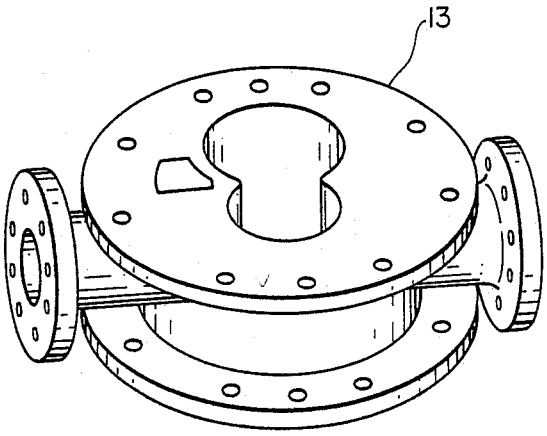
FIG. 8 is an appearance of a foamed polystyrene pattern of a screw vacuum pump casing.
Figure 9:
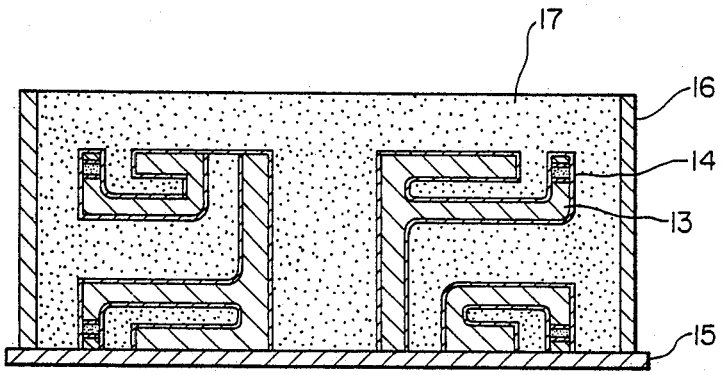
FIG. 9 is a crosssection of the foamed polystyrene pattern of the casing buried in the mold.

A foamed polystyrene pattern 13 (foaming ratio: 50) of a screw vacuum pump casing as shown in FIG. 8 was coated, over the whole surface thereof except for the top surface, with a low-viscosity solution of a one-pack type oxime-free silicone rubber by means of a spray gun to form a hardened coating film 14 of silicone rubber having a uniform thickness (about 100 μm) on the surface of the pattern.

The pattern was turned upside down, and fixed with the top surface or the surface having no silicone coating film 14 formed thereon on a pattern plate 15, followed by disposing a special-purpose metal flask 16 splittable into two parts around the pattern 13.

A uniformly mixed and sufficiently foamed gypsum slurry composed of 100 parts of foamable gypsum, 8 parts of a cellulose powder, and 90 parts of water was cast into the metal flask to bury the whole polystyrene pattern 13 in the above-mentioned gypsum slurry.

After one hour, the metal flask 16 and the plate 15 were taken away. The mold 17 was turned upside down, and allowed to stand in a vapor of trichloroethane for 30 minutes. The pattern 13 had its volume quickly reduced to 1/50 upon contact thereof with the vapor, and partially dropped and discharged outside the mold.

The presence of the insoluble thin coating film formed on the surface of the pattern 13 enabled the residue of the dissolved polystyrene to be very easily removed together with the coating film outside the mold without sticking to the inner wall of the mold at all.

The mold was dried in air for 12 hours, and in a drier of 80° C. for 8 hours.

A uniformly mixed alumina slip composed of an alumina powder of 2.5 μm in average particle size as the main component, a sintering assistant, a deflocculant, and distilled water was prepared, cast in the hollow of the above-mentioned mold 17, allowed to stand in air for 2 days, and dried in a furnace of 80° C. for 8 hours.

Thereafter, the mold 17 was gradually heated up from ordinary temperatures to 450° C., at which it was kept for 3 hours, followed by cooling of the furnace. Since the cooled mold 17 lost all the strength, an alumina green body was very easily taken out by vacuum suction and using a slightly compressed air.

Subsequently, the green body was put into a gas furnace, and gradually heated up from ordinary temperatures to 1650° C., at which it was kept for 3 hours, followed by gradual cooling. Thus an alumina casing sinter of good quality was obtained.

In substantially the same manner as described above in this example, a mold was prepared by filling a kneaded molding material composed of 100 parts of molding silica, and 6 parts of water-glass No. 3 instead of the molding material as used just above around the pattern and hardening the same with $CO_2$ gas. After drying the mold, a molten cast iron of 1,500° C. was cast into the mold to obtain a good cast iron casing.

When the same casing mold as described above was prepared according to the customary process involving splitting of a mold, the total number of master molds and cores exceeded 20, thus requiring a number of steps and a high level of skill for forming and assembling parts of the mold. Furthermore, the obtained green body had a number of burrs, and was very poor in dimensional accuracy and the skin of the molding as compared with the green body formed according to the process of this invention.

The effects of the process of the present invention attained in this example were substantially the same as those in the foregoing Example 1 to 3 though the extents of them were somewhat different.

[Example 5]

Figure 2:
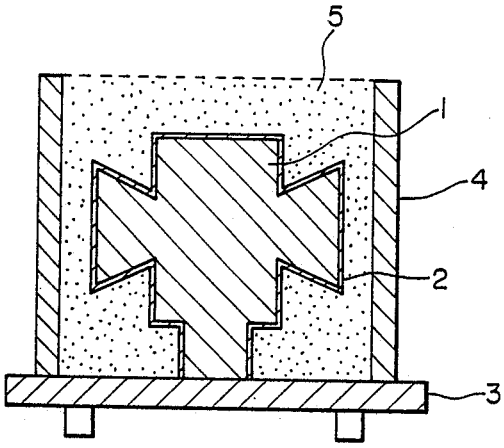
FIG. 2 is an illustrative view of the process for preparing the mold according to this invention.

A silicone rubber coating film 2 was formed over the whole surface of a foamed polystyrene specimen 1 (foaming ratio: 40) except for the top portion thereof in the same manner as in Example 1. The specimen 1 was turned upside down, and fixed in the middle portion of a wooden flask 4 disposed on a pattern plate 3 as shown in FIG. 2. A molding sand prepared by kneading 100 parts of alumina (250 to 325 meshes), 12 parts of $K_2CO_3$, and 13 parts of water was tamped around the specimen to form a mold in which the foamed polystyrene specimen 1 was buried. Two pieces of molds 5 having a specimen buried therein were prepared according to the above procedure, and turned upside down, followed by removal of the plate 3 and the wooden flasks 4.

A mold No. 1 was sprayed with acetone from above the top of the specimen or the portion having no silicone coating film. The pattern was quickly dissolved to have its volume reduced to about 1/40. As for the mold No. 2, no solvent such as acetone was used at this time.

TABLE 2

| No. | Use of solvent in wet state of mold | Breakage of mold by thermal expansion of mold | Adherence of residue to inner wall of mold | Rating |
|---|---|---|---|---|
| 1 | used | not broken | No adherence at all. The rubber coating film, the residue, and the acetone were easily removed en bloc outside the mold | O |
| 2 | not used | broken | — | X |

*A one-pack type oxime-free silicone rubber was used.

For drying, the molds Nos. 1 and 2 were kept in a drier of 100° C. for 3 hours. Thereafter, the appearances of the two molds were checked. The mold No. 1 which was sprayed with the solvent when it was in a wet state, did not have any abnormality at all, while the mold No. 2, which was not sprayed with any solvent, was broken into pieces because of large expansion of the foamed polystyrene pattern by heating it up to 100° C. The state of adherence of the residue of dissolution to the inner wall of the mold was shown in Table 2 above.

Thus, a water-soluble mold having a desired hollow without any residue of dissolution and coating film sticking to the inner wall was obtained from the mold sprayed with acetone in a wet state.

[Example 6]

In substantially the same manner as in Example 2, a foamed polystyrene pattern 6 (volume: about 200 $cm^3$, ratio: 50) formed into the same shape as that of a casing of a turbo charger for a vehicle as shown in FIG. 3 was coated, over the whole surface thereof except for the top portion, with a silicone rubber and, after hardening of the silicone rubber, fixed on a pattern plate, followed by disposing of a wooden flask therearound.

A molding sand prepared by kneaded 100 parts of alumina (350 to 325 meshes), 12 parts of $K_2CO_3$, and 13 parts of water was tamped around the polystyrene pattern to bury the above-mentioned pattern. The mold was immediately turned upside down to remove the wooden flask and the plate. About 100 $cm^3$ of acetone was poured through the gate of the pattern. The pattern 6 was quickly dissolved from the upper portion upon contact thereof with acetone. The residue stuck onto the inner surface of the rubber coating film. Subsequently, the mold was turned upside down to remove excess acetone outside the mold, and allowed to stand in air for 3 hours to evaporate remaining acetone, thus completely removing the acetone outside the mold.

The mold was put into an electronic oven, and irradiated with microwaves for 10 minutes to be dried and hardened. Subsequently, acetone was sprayed from the gate over the residue of the dissolved pattern to soften the residue hardened by heating, again. Thus, pulling up the silicone coating film enabled the residue of dissolution and the rubber coating film in a state of enclosing the residue to be easily removed outside the mold. As a result, a desired mold hollow having a high dimensional accuracy and a smooth skin was formed. The resulting mold was put into an electronic oven again, and irradiated with microwaves for 20 minutes to be dried and hardened.

An $Si_3N_4$ slip composed of an $Si_3N_4$ powder of 0.5 μm in average particle size as the main component, a deflocculant, a binder, and distilled water was cast into the hollow of the above-mentioned mold. After 2 hours, it was confirmed that the green body was hardened. Thereafter the mold was broken into pieces. At this time, water was sprayed over the mold to facilitate the collapse of the mold. Accordingly, the molding material was removed very easily. Thus a green body of $Si_3N_4$ having no burr, a high dimensional accuracy, and a smooth surface was obtained.

The green body was put into a nitriding furnace, and gradually heated up from room temperature to 1,850° C., at which it was kept for 2 hours, followed by gradual cooling. Thus, a turbo charger casing 7 of a high density comprising completely sintered $Si_3N_4$ as shown in FIG. 4 was obtained.

A molten copper alloy was cast, instead of the $Si_3N_4$ slip, into the hollow of a dried and hardened mold as prepared in the same manner as described above in this Example. After solidification of the metal, the mold and a molding formed therein were immersed in water to obtain a good copper alloy turbo charger casing.

[Example 7]

In substantially the same manner as in Example 3, a foamed polystyrene pattern 8 (foaming ratio: 50) of a male rotor for a screw compressor as shown in FIG. 5 was coated, over the whole surface thereof except for the upper end surface of the gate portion, with a urethane sealant rubber using a brush, and allowed to stand in air. As a result, the coating film reacted with water in air to form an about 80 μm-thick urethane rubber hardened coating film 9 as shown in FIG. 6.

In the same manner as in Example 5, the pattern 8 was fixed on a pattern plate with the gate portion bonded to the plate with an adhesive, followed by disposing of a metal flask therearound. A molding sand prepare by kneaded 100 parts of zircone sand (250 to 325 meshes), 20 parts of $K_2PO_4$, and 8 parts of water was tamped around the mold. The mold was immediately turned upside down to take away the metal flask and the plate. Trichloroethane was poured through the gate of the pattern to dissolve it. The pattern 8 was quickly dissolved from the upper portion thereof upon contact thereof with trichloroethane. The residue stuck to the inner surface of the urethane rubber coating film. Subsequentially, the mold was turned upside down to remove excess trichloroethane outside the mold, and allowed to stand in air for one hour to evaporate remaining solvent, thus completely removing the solvent outside the mold.

The resulting mold was irradiated with microwaves for 20 minutes in the same manner as in Example 6 to be dried and hardened. Subsequently, trichloroethane was spread over the residue of the pattern through the gate of the mold to soften the residue hardened by heating again. Thus, pulling up the urethane coating film 9 enabled the residue of dissolution and the rubber coating film in a state of enclosing the residue to be very easily picked and removed from the hollow of the mold to form a desired mold hollow.

Figure 7:
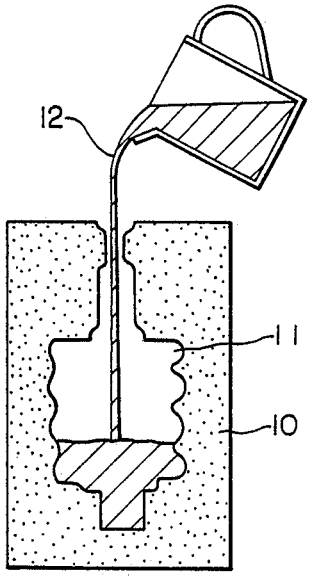
FIG. 7 is an illustrative view of casting of a slip or a molten mold steel into the hollow of the mold from which the foamed polystyrene pattern has been removed.

As shown in FIG. 7, a uniformly mixed zirconia slip 12 composed of a zirconia powder of a solid solution with $Y_2O_3$ containing 80% of particles of 1 μm or less in size as the main component, a deflocculant, a binder, and distilled water was cast into the hollow 11 of the above-mentioned mold 10, and allowed to stand in air for 5 hours, followed by confirming that the green body was hardened. Subsequently, water was sprayed over the water-soluble mold in the same manner as in Example 2. The molding material was removed very easily to obtain a zirconia green body having no burr at all, a high dimensional accuracy, and a smooth surface.

The green body was put into a calculation furnace, and gradually heated up to 1,500° C., at which it was heated for 3 hours to obtain a uniform and complete zirconia sinter.

A molten mold steel of 1,650° C. was cast into the hollow of a dried and hardened mold as prepared in the same manner as described above in this Example. After solidification of the metal, pressurized water was sprayed over the mold and a molding formed therein to obtain a uniform and complete mold steel rotor.

[Example 8]

In substantially the same manner as in Example 4, a foamed polystyrene pattern 13 (foaming ratio: 50) of a casing as shown in FIG. 8 was sprayed, over the whole surface thereof except for the upper end surface, with a low-viscosity solution of a one-pack type oxime-free silicone rubber to form a silicone rubber hardened coating film 14 having a uniform thickness of about 100 μm on the surface of the pattern.

The pattern was turned upside down, and fixed with the upper end surface or the surface having no silicone rubber coating film 14 formed thereon being in contact with a pattern plate 15, followed by disposing of a special-purpose metal flask 16 splittable into two parts around the pattern 13.

A modeling material was prepared by kneading 100 parts of $Al_2O_3$ (250 to 325 meshes), 10 parts of $Na_2CO_3$, and 12 parts of water was prepared, and filled around the above-mentioned pattern.

The mold 17 was immediately turned upside down and the metal flask 16 and the plate 15 were taken away. The mold was then allowed to stand in a vapor of trichloroethane for 30 minutes. The pattern 13 had its volume quickly reduced to 1/50 upon contact thereof with the solvent vapor, and partially dropped and discharged outside the mold. Thereafter the mold was dried and hardened in a drying furnace of 200° C.

After drying, trichloroethane was sprayed over the residue of dissolution to soften the residue hardened by heating again. Thus, pulling up the silicone rubber coating film enabled the residue of dissolution and the rubber coating film in a state of enclosing the residue to be very easily picked and removed to form a desired mold hollow. The mold was assembled at the upper surface thereof with a ground lid having a gate and a riser gate and made of the same water-soluble molding material as described above.

A uniformly mixed alumina slip composed of an alumina powder of 2.5 μm in average particle size as the main component, a sintering assistant, a deflocculant, and distilled water was prepared, cast into the hollow of the above-mentioned mold 17, and allowed to stand in air for 3 hours, followed by confirming that the green body was hardened. Subsequently, water was sprayed over the water-soluble mold. The alumina green body was very easily taken out.

Thereafter the green body was put into a gas furnace, and gradually heated up from ordinary temperatures to 1,650° C., at which it was kept for 3 hours, followed by gradual cooling. Thus an alumina casing sinter of good quality was obtained.

A molten cast iron of 1,300° C. was cast into the hollow of a mold 17 as prepared in the same manner as described above in this Example, followed by solidification of the metal. Thereafter they were immersed in water and allowed to stand. The molding material was very easily removed to obtain a good casing molding having no burr.

Although the process of the present invention has been exemplified above by referring to the slip casting of a fine ceramic powder and metal casting alone, it can be evidently applied as such to the slip casting of conventional ceramics such as pottery or cement, a metal powder, and a resin powder, and to the casting of molten nonmetallic matters such as resin or glass.

In such applications of the process of this invention, however, it should be noted that a suitable mold should be chosen with due consideration for the temperature and other properties of the molding material.

What is claimed is:

1. A process for preparing a mold for casting which comprises;

making a pattern from an organic material soluble in a solvent;

forming a coating film on the surface of said pattern from a material insoluble in said solvent to prepare a mold pattern;

filling an area around said mold pattern with a molding material for forming a mold;

dissolving said pattern with said solvent to form dissolved pattern residue of reduced volume while said molding material is in a non-hardened state;

hardening said mold by heating; and removing the dissolved pattern residue with said coating film from said mold to create a casting cavity in the mold into which a fluid material can be poured.

2. A process for preparing a mold for casting as claimed in claim 1, wherein said pattern is a formed body made rom a member selected from the group consisting of foamed polystyrene, polyethylene, and p-dichlorobenzene.

3. A process for preparing a mold for casting as caimed in claim 1, wherein said coating fillm is formed from a cold-setting silicone rubber.

4. A process for preparing a mold for casting as claimed in claim 1, wherein said coating film is formed from a urethane sealant rubber.

5. A process for preparing a mold for casting as claimed in claim 3, wherein said coating film is formed from a one-pack type oxime-free silicone rubber.

6. A process for preparing a mold for casting as claimed in claim 1, further comprising casting a fluid material into said casting cavity.

7. A process for preparing a mold for casting as claimed in claim 1, wherein said dissolved pattern residue and said coating film are removed from said mold together.

8. A process for preparing a mold for casting as claimed in claim 1, wherein said mold pattern is placed in a container and said molding material is filled in an area around said mold pattern in said container.

9. A process for preparing a mold for casting as claimed in claim 1, wherein said molding material is solidified before dissolving said pattern with said solvent.

10. A process for preparing a mold for casting which comprises;

making a pattern from an organic material soluble in a solvent;

forming a coating film on the surface of said pattern from a material insoluble in said solvent to prepare a mold pattern;

filling a molding material comprising a water soluble binder for forming a mold;

contacting said pattern with said solvent when said mold is still in a non-hardened state to dissolve said pattern and form a dissolved pattern residue of reduced volume;

hardening said mold by heating;

contacting said dissolved pattern residue with said solvent; and removing said dissolved pattern residue and said coating film from said mold.

11. A process for preparing a mold for casting as claimed in claim 10, wherein said pattern is a formed body made from a member selected from the group consisting of foamed polystyrene, polyethylene, and p-dichlorobenzene.

12. A process for peparing a mold for casting as claimed in claim 10, wherein said coating film is formed from a cold-setting silicone rubber.

13. A process for preparing a mold for casting as claimed in claim 10, wherein said coating film is formed from a urethane sealant rubber.

14. A process for preparing a mold for casting as claimed in claim 10, wherein said coating film is a one-pack type oxime-free silicone rubber.

15. A process for preparing a mold for casting as claimed in claim 10, wherein said water-soluble binder is a carbonate.

16. A process for preparing a mold for casting as claimed in claim 15, wherein said carbonate is a member selected from the group consisting of sodium carbonate and potassium carbonate.

17. A process for preparing a mold for casting as claimed in claim 10, wherein said water-soluble binder is a sulfate.

18. A process for preparing a mold for casting as claimed in claim 17, wherein said sulfate is a member selected from the group consisting of ammonium sulfate, potassium hydrogensulfate and sodium hydrogensulfate.

19. A process for preparing a mold for casting as claimed in claim 10, wherein said water-soluble binder is a chloride.

20. A process for preparing a mold for casting as claimed in claim 10, wherein said water-soluble binder is a phosphate.

21. A process for preparing a mold for casting as claimed in claim 10, further comprising casting a fluid material into said mold.

22. A process for preparing a mold for casting as claimed in claim 10, wherein said molding material is filled in the area around said mold pattern.

23. A process for preparing a mold for casting as claimed in claim 10, wherein said dissolved pattern residue and said coating film are removed from said mold together.

24. A process for preparing a mold for casting as claimed in claim 10, wherein said mold pattern is placed in a container and said molding material is filled in an area around said mold pattern in said container.

25. A process for preparing a mold for casting which comprises:

making a pattern of a given volume from organic material soluble in a solvent;

forming a flexible coating film on the surface of said pattern from a material insoluble in said solvent to prepare a mold pattern;

placing said mold pattern in container;

filling an area around said mold pattern in said container with molding material to form a mold;

treating said pattern with said solvent to form a pattern residue of reduced volume while said molding material is in a non-hardened state;

hardening said mold by heating; and removing said pattern residue and said flexible coating together from said mold to create a casting cavity in said mold into which a fluid material can be poured.

26. A process for preparing a mold for casting as claimed in claim 25, wherein, in treating said pattern with said solvent, said pattern is dissolved.

27. A process for preparing a mold for casting as claimed in claim 25, wherein said molding material is solidified before treating said pattern with said solvent.

28. A process for preparing a mold for casting, comprising:

making a pattern of a given volume from an organic material soluble in a solvent;

forming a flexible coating film on the surface of said pattern from a material insoluble in said solvent to prepare a mold pattern;

filling an area around said mold pattern with a molding material comprising a water-soluble binder for forming a mold;

treating said mold pattern with said solvent when said mold is still in a non-hardened state to form a mold pattern residue of reduced volume;

hardening said mold by heating;

contacting said mold pattern residue with said solvent; and removing said mold pattern residue and said coating film from said mold.

29. A process for preparing a mold for casting according to claim 28, wherein said pattern is a formed body made from a material selected from the group consisting of foamed polystyrene, polyethylene and P-dichlorobenzene.

30. A process for preparing a mold for casting according to claim 28, wherein said coating film is formed from a cold-setting silicone rubber.

31. A process for preparing amold for casting according to claim 28, wherein said coating film is formed from a urethane sealant rubber.

32. A process for preparing a mold for casting according to claim 30, wherein said coating film is formed from a one-pack type oxime-free silicone rubber.

33. A process for preparing a mold for casting according to claim 28, wherein said water soluble binder is a carbonate.

34. A process for preparing a mold for casting according to claim 33, wherein said carbonate is a member selected from the group consisting of sodium carbonate and potassium carbonate.

35. A process for preparing a mold for casting according to claim 28, wherein said water soluble binder is a sulfate.

36. A process for preparing a mold for casting according to claim 35, wherein said sulfate is a member selected from the group consisting of ammonium sulfate, potassium hydrogensulfate and sodium hydrogensulfate.

37. A process for preparing a mold for casting according to claim 28, wherein said water soluble binder is a chloride.

38. A process for preparing a mold for casting according to claim 37, wherein said chloride is a member selected from the group consisting of potassium chloride, magnesium chloride and lithium chloride.

39. A process for preparing a mold for casting according to claim 28, wherein said water soluble binder is a phosphate.

40. A process for preparing a mold for casting according to claim 39, wherein said phosphate is a member selected from the group consisting of sodium phosphate, potassium phosphate and dipotassium hydrogenphosphate.

41. A process for preparing a mold for casting according to claim 28, wherein said solvent is at least one member selected from the group consisting of acetone, trichloroethylene, trichlorethane, tetrachloroethylene, carbon tetrachloride, benzene and benzine.

* * * * *